US008116493B2

(12) United States Patent
Westermann

(10) Patent No.: US 8,116,493 B2
(45) Date of Patent: Feb. 14, 2012

(54) METHOD OF PREPARING A HEARING AID, AND A HEARING AID

(75) Inventor: Soren Erik Westermann, Gronholtvej (DK)

(73) Assignee: Widex A/S, Lynge (DK)

( * ) Notice: Subject to any disclaimer, the term of this patent is extended or adjusted under 35 U.S.C. 154(b) by 1272 days.

(21) Appl. No.: 11/766,586

(22) Filed: Jun. 21, 2007

(65) Prior Publication Data

US 2007/0242845 A1 Oct. 18, 2007

Related U.S. Application Data

(62) Division of application No. PCT/DK2004/000899, filed on Dec. 22, 2004.

(51) Int. Cl.
*H04R 25/00* (2006.01)

(52) U.S. Cl. ..... 381/327; 381/330

(58) Field of Classification Search ..... 381/312, 381/330

See application file for complete search history.

(56) References Cited

U.S. PATENT DOCUMENTS

| | | | | |
|---|---|---|---|---|
| 3,297,832 | A | 1/1967 | Brown | |
| 3,513,269 | A * | 5/1970 | Wilson | 381/330 |
| 4,456,795 | A | 6/1984 | Saito et al. | |
| 4,622,440 | A | 11/1986 | Slavin et al. | |
| 4,917,504 | A | 4/1990 | Scott et al. | |
| 6,959,097 | B1 * | 10/2005 | Borowsky | 381/328 |
| 2002/0191805 | A1 | 12/2002 | Hagen | |

FOREIGN PATENT DOCUMENTS

| | | | |
|---|---|---|---|
| DE | 178475OU | U | 3/1959 |
| GB | 792742 | A | 4/1958 |
| JP | 61-238198 | | 10/1986 |
| JP | 10-023599 | | 1/1998 |
| WO | WO 98/47319 | A1 | 10/1998 |
| WO | WO 01/05190 | A2 | 1/2001 |
| WO | WO 2004/004416 | A1 | 1/2004 |
| WO | WO 2006/026988 | A1 | 3/2006 |

* cited by examiner

*Primary Examiner* — Brian Ensey
(74) *Attorney, Agent, or Firm* — Sughrue Mion, PLLC

(57) ABSTRACT

The present invention relates generally to hearing aids and to methods of manufacturing hearing aids. The invention further relates to shells for hearing aids and methods of manufacturing thereof. The invention, more particularly, relates to custom-made BTE hearing aids. A shell comprising a first part, and a second part, wherein said first part is adapted to fit the contour of the cleft between a pinna and the skull of an individual is provided. The shell may be part of a hearing aid (17) that is connected with a tube (9) in a first end and an earplug (20) in a second end. In a third aspect of the invention a method of preparing the shell is disclosed and in a fourth aspect a method of manufacturing a hearing aid is also disclosed.

7 Claims, 16 Drawing Sheets

Section A-A

Section A-A

SECTION A-A

METHOD OF PREPARING A HEARING AID, AND A HEARING AID

RELATED APPLICATIONS

The present application is a continuation-in-part of application No. PCT/DK2004/000899, filed on Dec. 22, 2004, in Demark and published as WO 2006/066570 A1.

BACKGROUND OF THE INVENTION

1. Field of the Invention

The present invention relates generally to hearing aids and to methods of manufacturing hearing aids. The invention, more specifically relates to Behind-The-Ear (BTE) hearing aids and methods of preparing them. The invention, still more particularly, relates to custom-made BTE hearing aids.

2. The Prior Art

Behind-the-ear (BTE) hearing aids is a subgroup within the general group of hearing aids worn by the ear. Hearing aids supported entirely by the ear are normally divided into three classes: Behind-The-Ear (BTE) hearing aids, In-The-Ear (ITE) hearing aids and Completely-In-the-Canal (CIC) hearing aids. A BTE hearing aid is the largest type and basically incorporates a housing or a shell that is adapted for being placed partially above and partially behind the users outer ear (the pinna). The housing provides a platform and encapsulation for electronic and acoustic components, such as a battery, a microphone, and an amplifier. In some types, the housing also contains a miniature loudspeaker, in the hearing aid parlance usually referred to as a receiver, which connects to a tube for conveying the receiver output into the ear canal of the user. The tube ends in an earpiece that couples with the ear canal. The earpiece may comprise a soft standard plug or it may comprise a customized plug. In use the housing is placed behind the external ear, partially concealed. In some BTE's the housing extends into a hook that serves the purpose of resting the hearing aid housing. U.S. Pat. No. 6,228,020 shows a hearing aid with a faceplate and a shell customized to fit in the user's ear canal.

WO-98/47319 shows a hearing aid for arrangement in a user's ear canal and including a shell customized to the users ear canal, components and a faceplate.

DE-U-1784750 discloses a BTE hearing aid with an individually formed housing, which housing is molded by a method as is known from the field of dentistry, so as to fill the space between the pinna and the head of the user. In the housing there is a hearing aid connected to an ear piece by an air conduit. The disclosure gives no enablement regarding how to integrate hearing aid components into the housing.

AT patent 194933 discloses a BTE hearing aid, wherein the housing is provided with exterior plastic moldings adapted to improve the seat. The housing may be provided with an aperture for threading through a side bar of a pair of glasses.

BTE hearing aids offer space for large batteries, larger amplifiers, telecoils, dual microphones, push buttons and switches to change between various functions etc. Such features are difficult or impossible to implement in smaller types. BTE hearing aids also permit the arrangement of a microphone and a receiver with a mutual spacing that better permits controlling acoustic feedback from the receiver to the microphone. Some users may find BTE hearing aids more comfortable in wearing. Thus, many users find good reasons to prefer BTE hearing aids rather than ITE or CIC hearing aids.

The state of the art BTE hearing aid comprises a standard housing that is curved to suit the general contour of the cleft between a pinna (left or right) and the skull of a user. The top part of the housing normally extends into a projecting hook that incorporates a sound conduit and provides a grip around the top part of the cleft between pinna and skull.

SUMMARY OF THE INVENTION

It is an object of the invention to provide a method of manufacturing a hearing aid that is simple and that yields a hearing aid that is comfortable in use.

It is a further object of the invention to provide a hearing aid that is simple in manufacture.

It is a yet further object of the invention to provide a hearing aid that can be manufactured without requiring capital intensive equipment.

It is a still further object to provide a hearing aid with excellent and comfortable retention on the user.

The invention, in a first aspect provides a method of preparing a Behind-The-Ear hearing aid for an individual hearing aid user, said method comprising the steps of providing an impression having a first part and a second part, the first part being directly cast by contact with the cleft between the skull and a pinna of said user, and the second part being adapted to complete the impression, molding a shell using the impression as a form, cutting said shell, whereby to provide a housing that has an aperture encircled by an edge, providing a faceplate, which faceplate has an entrance opening, adhering said faceplate to said edge, providing a module for supporting an amplifier assembly and a battery compartment, and inserting and securing said module through said entrance opening, whereby to complete the Behind-The-Ear hearing aid.

This provides an effective and accurate method for preparing a hearing aid that excels in fit and user comfort.

Within the context of this disclosure the expression a custom shell signifies a shell that includes structure that has been adapted to an individual.

As far as known to the inventor, within the context of commercial BTE hearing aids, customization has only been extended to the preparation of the earpiece, never to the housing.

This hearing aid shell includes a part that is customized to fit the contour of the cleft between a pinna and the skull of an individual. This part will normally rest against corresponding parts of the cleft, and thereby provides for a shell that is superior in fit and comfort. The shell includes a second part that generally completes the shell but that is not necessarily adapted to rest in direct contact with the cleft of the user.

The two parts may be manufactured integrally or they may be manufactured in separate stages and joined together by conventional means.

According to embodiments, the shell may comprise an outlet. The outlet may be an opening for an acoustic output that can be conveyed by a tube to an ear plug inserted in the users ear canal, or it may be an electric lead or a connector for an electric output, that is fed to a receiver arranged spaced from the housing, e.g. in an earpiece, and close to the users ear canal.

Preferably, the outlet is arranged in the second shell part. Keeping the outlet away from the part of the shell intended to rest against the users avoids compromising the fit.

According to an embodiment, the shell may be extended into a hook, and the hook may accommodate the outlet. The hook may be partially customized to the user or it may be a standard shape, suitably arranged on the housing.

According to an embodiment, the shell comprises a third part, which is adapted to fit a part of an arm of a spectacle frame. This provides a superior fit of the hearing aid for a user who wishes to wear spectacles and hearing aids at the same time.

According to an embodiment, the shell may include a faceplate. The faceplate may be a standard plate with various components, possibly cut to match a contour of the custom shell, in order that the shell and the faceplate together will produce a coherent appearance. The faceplate may preferably be arranged in that part of the shell that is not adapted to contact the user directly.

The invention, in a second aspect, provides a hearing aid comprising a housing, a faceplate and a module, wherein said housing is manufactured by providing an impression having a first part and a second part, the first part being directly cast by contact with the cleft between the skull and a pinna of said user, and the second part being adapted to complete the impression, molding a shell using the impression as a form, and cutting said shell, whereby to provide a housing that has an aperture encircled by an edge, wherein said faceplate has an entrance opening and is adhered to said housing at said edge, and wherein said module includes an amplifier assembly and a battery compartment, and is adapted for mounting in the housing by inserting and securing said module through said entrance opening.

Further embodiments will appear from the dependent claims.

Further objects, embodiments and advantages will appear from the detailed part of the specification.

BRIEF DESCRIPTION OF THE DRAWINGS

The invention will now be described in more detail with reference to the accompanying drawings, where.

DETAILED DESCRIPTION OF THE INVENTION

Figure 1:
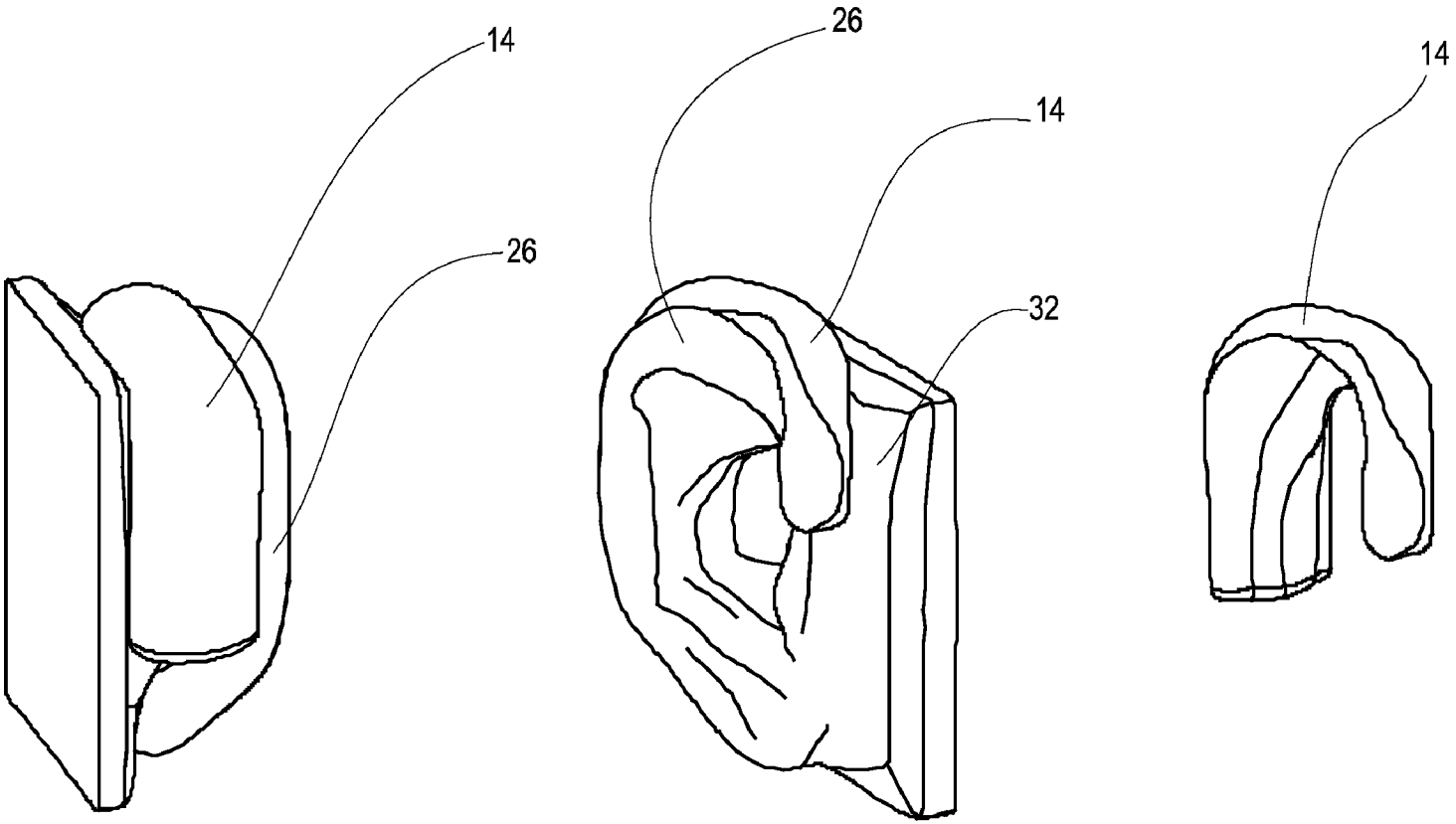
FIG. 1 illustrates a first step in preparation of a shell.

A way of preparation of a shell:

The first step in preparing of a shell comprises providing a cast impression 14 in the area behind the ear, i.e. in the cleft between the skull 32 and pinna 26, e.g. as the one illustrated in FIG. 1. During the casting it is important not to strain or deform pinna in order that the impression will match the actual space of the cleft behind the ear while the ear and the pinna are relaxed. If the hearing aid user normally wears spectacles, an impression of part of an armature of a spectacle frame can be made in the cast impression 14.

The cast impression includes a surface portion directly cast by contact with the user and another surface portion that completes the impression and that has not been in direct contact with the user.

The second step in the preparation is to trim the impression to a desired form. During this second step the impression is waxed and a silicone control form is made. The control form is used to trim the impression further in order to make the final version of the impression. A dummy may be used to determine where the impression should be trimmed. The third step in the preparation is to wax and trim the final impression and the fourth step is to fill the form with an acrylic e.g. beige photoplast and irradiate the form with ultraviolet light, so that the acrylic hardens to a shell. In a fifth step the un-hardened acrylic in surplus is removed and the remaining shell is cut so as to leave a shell of a suitable size with a view to the desired size of the BTE housing and with a planar aperture.

In a further step, a faceplate is adhered to an edge of the aperture and any protruding parts of the faceplate are cut off Further steps may be added in the preparation of the shell, such as a step of drilling a sound outlet.

Examples of the BTE hearing aids with housings that are positioned various places behind the ear are shown in the FIGS. 2-5. The size of housing and thus the shell is selected with a view to the electronics to be mounted inside. If e.g. the hearing aid is to be used for mild to moderate hearing losses, electronic components corresponding to those available for Completely-In-the-Canal, CIC, hearing aids can be used.

The electronic components, e.g. microphone, signal processor and receiver, may be mounted through the battery opening. A sound tube may be connected by one end to a receiver while the other end is pulled through a sound outlet in the shell and connected to an earplug. Alternatively, if e.g. the hearing aid is to be used for severe hearing losses, the BTE housing may be connected by an electrical wire to a receiver in an earplug, thereby permitting a higher sound output without causing feedback.

Figure 2:
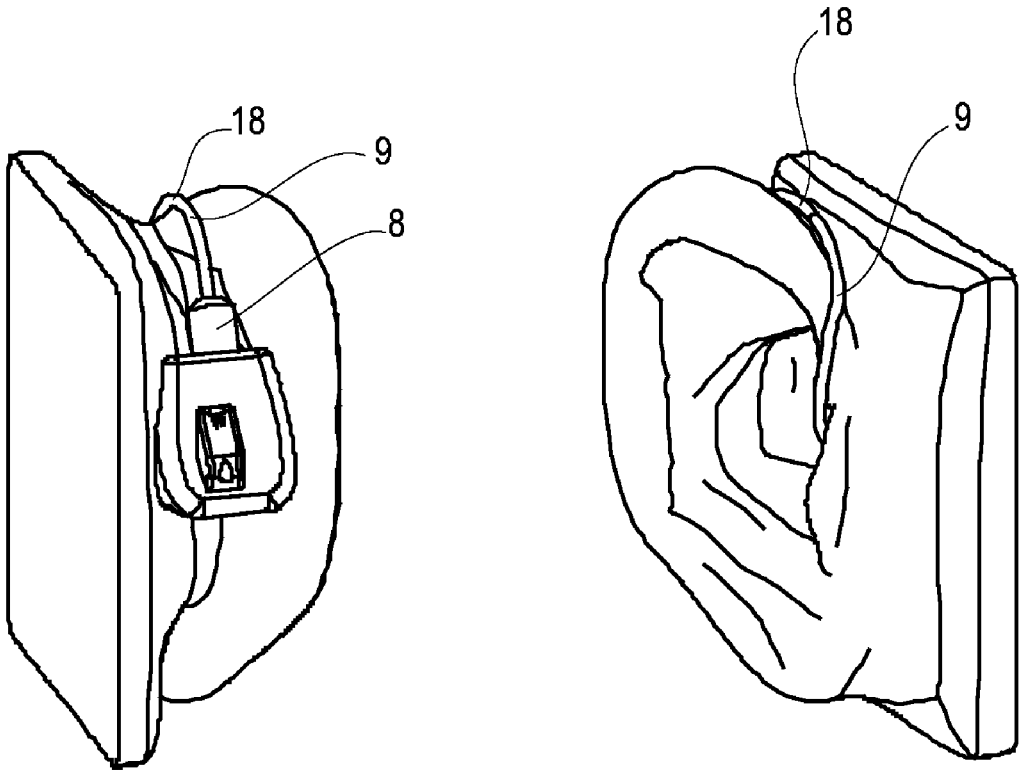
FIG. 2 illustrates a hearing aid with a housing arranged in a low position behind the ear.
Figure 3:
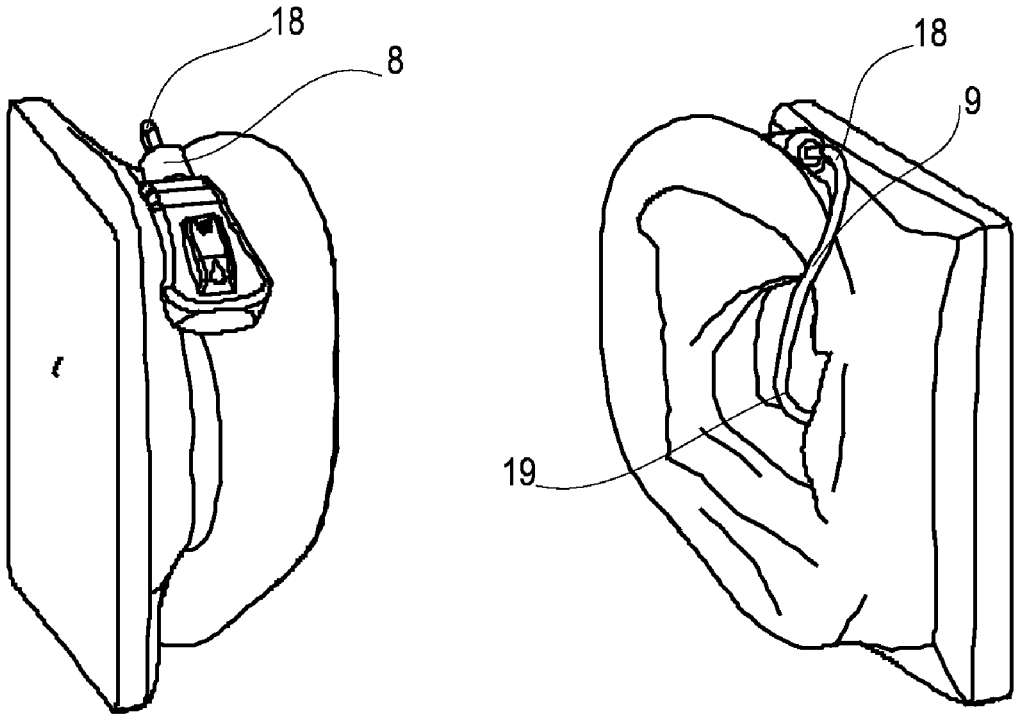
FIG. 3 illustrates a hearing aid with a housing arranged in a medium position behind the ear.
Figure 4:
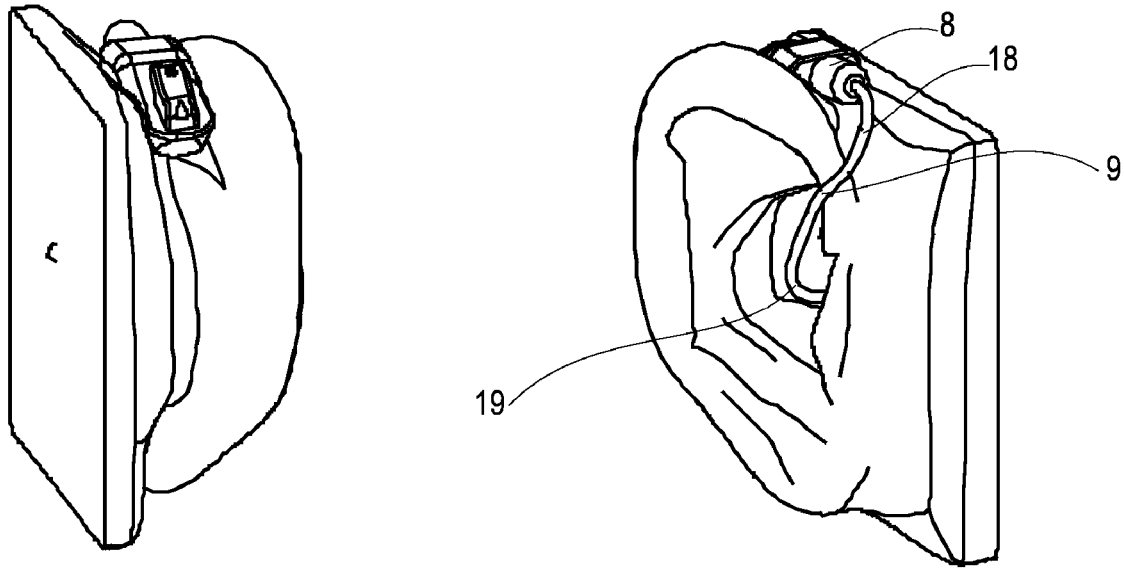
FIG. 4 illustrates a hearing aid with a housing arranged in a high position behind the ear.

In FIG. 2-4 the housing is connected with a connecting element 8 on a tube 9, the tube 9 having a first bend 18 around the top of the pinna of the users ear directing it into the concha of the ear and a second bend 19 to direct an end of the tube into the ear canal of the user. The tube is resilient and assists to keep the housing in a fixed position behind the ear and the earplug 20 in a fixed position in the ear canal.

Figure 5:
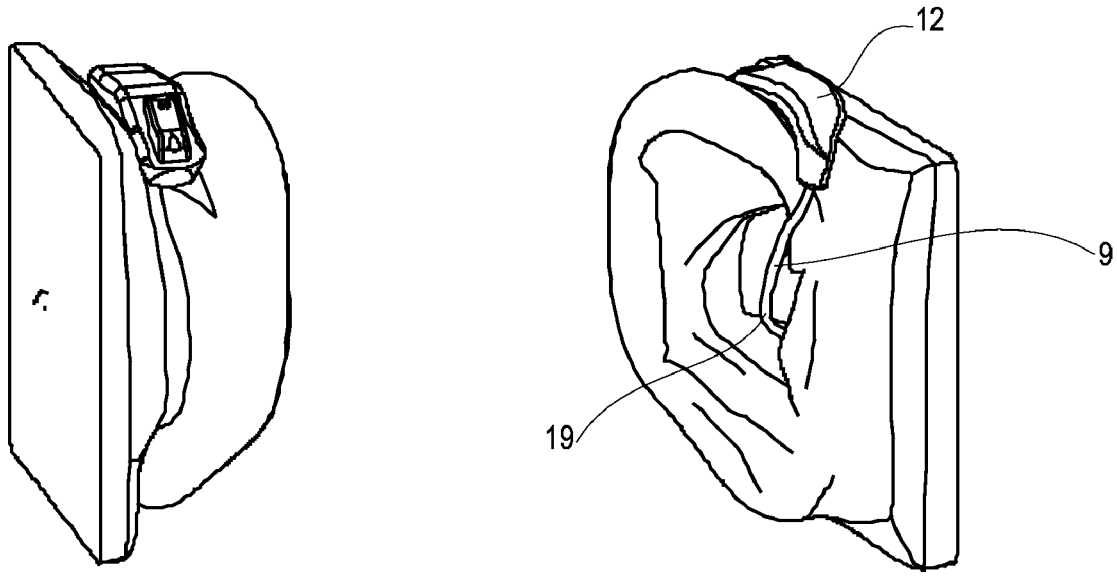
FIG. 5 shows a BTE hearing aid with a hook.

FIG. 5 shows a custom made BTE hearing aid wherein the forward part of the housing is formed as a hook 12 around the top of the ear and a tube 9 is fitted through the outlet opening of the housing.

Figure 6:
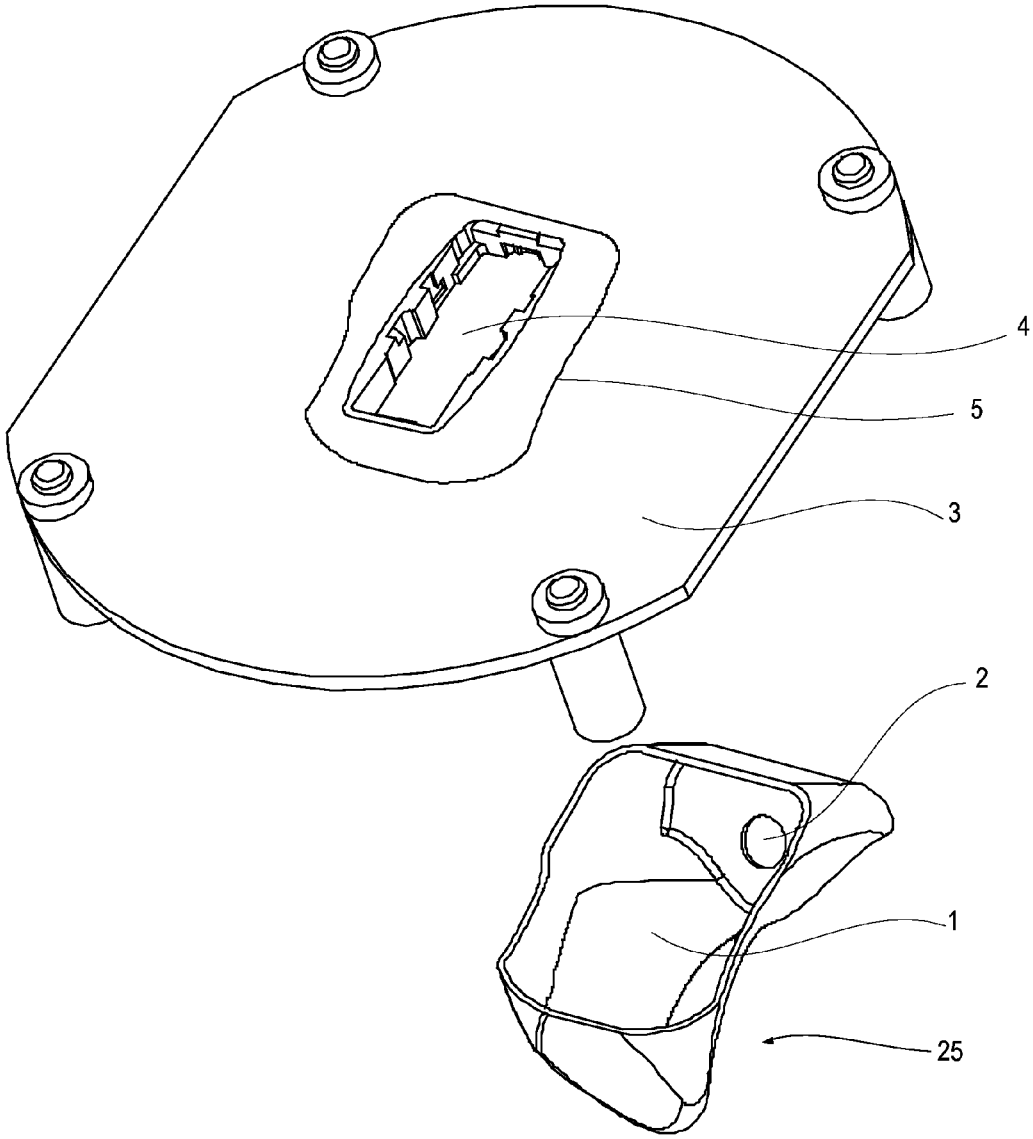
FIG. 6 shows a shell for a BTE hearing aid and a faceplate.
Figure 7:
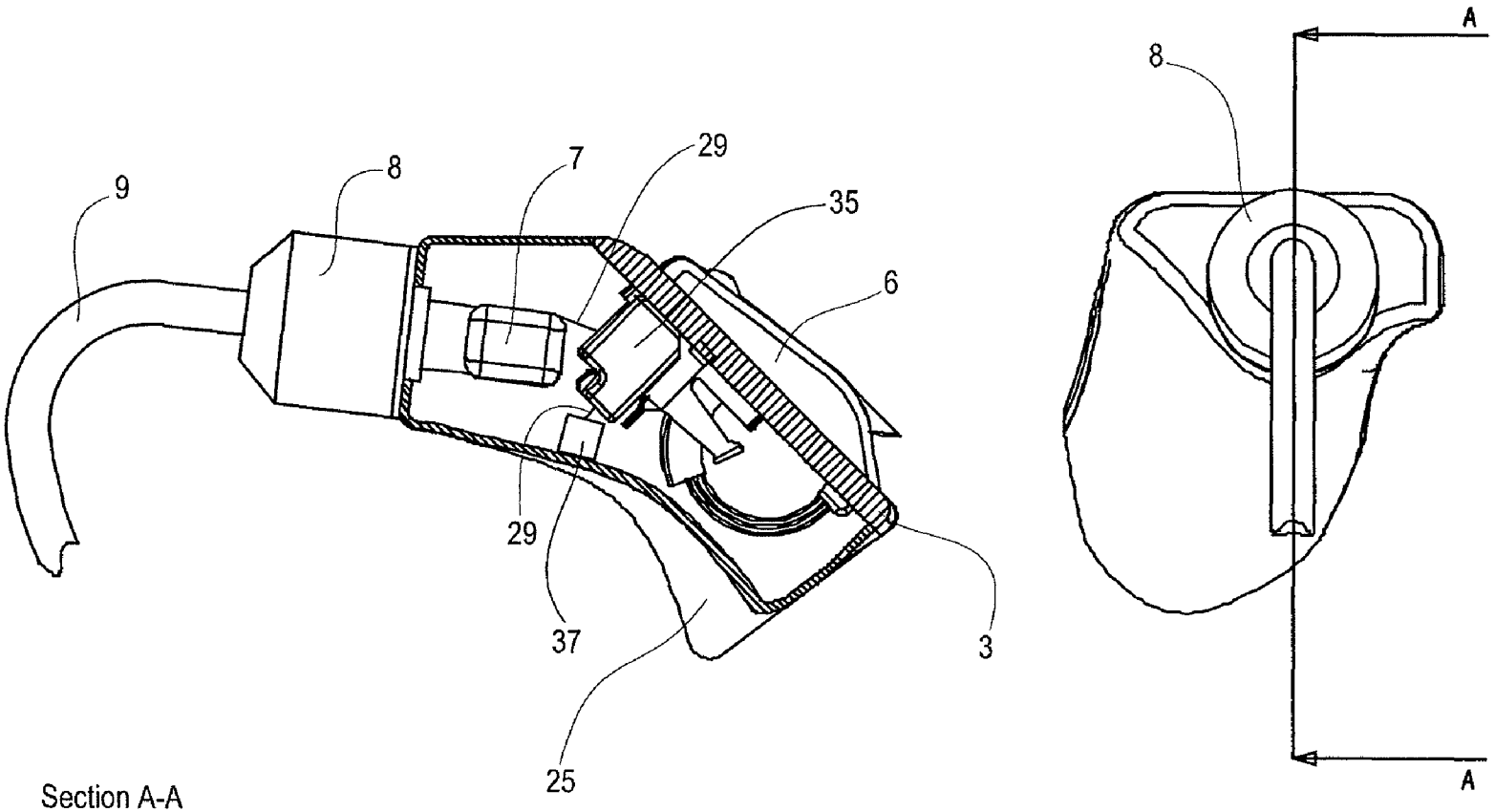
FIG. 7 shows a shell joined with a faceplate.

FIG. 6 shows a shell 25 for a BTE hearing aid with a corresponding faceplate 3. The shell 25 has an aperture 1 and an outlet opening 2. The faceplate 3 has a prefabricated entrance opening 4 for mounting a battery compartment, and the dotted line 5 indicates the final contour of the faceplate 3 when mounted onto the shell 25. The faceplate 3 may e.g. be mounted by gluing the faceplate 3 and the shell 25 together. After gluing, the faceplate is trimmed by cutting away the parts protruding beyond the shell aperture. The electronic components are mounted in the shell through the entrance opening after trimming, e.g. as described in WO 98/47319. FIG. 7 shows the shell 25 joined with the faceplate 3, a battery door 6 in the faceplate, and the electronic components, such as a microphone, a receiver 7, an electronics module 35 including a signal processor and a telecoil 37. The shell 25 is connected to a tube 9 via a connecting element 8.

The shell comprises a first part 23 that matches a surface of the user and a second part 24, distinguished from the first part by demarcation line 36, which completes the shell. The second part generally includes a faceplate and a transition area connecting the faceplate to the first part. Thus, the first part is fully customized to the user, the second part is customized to match the first part along a selected contour, and the faceplate may be a standard shape.

Figure 13:
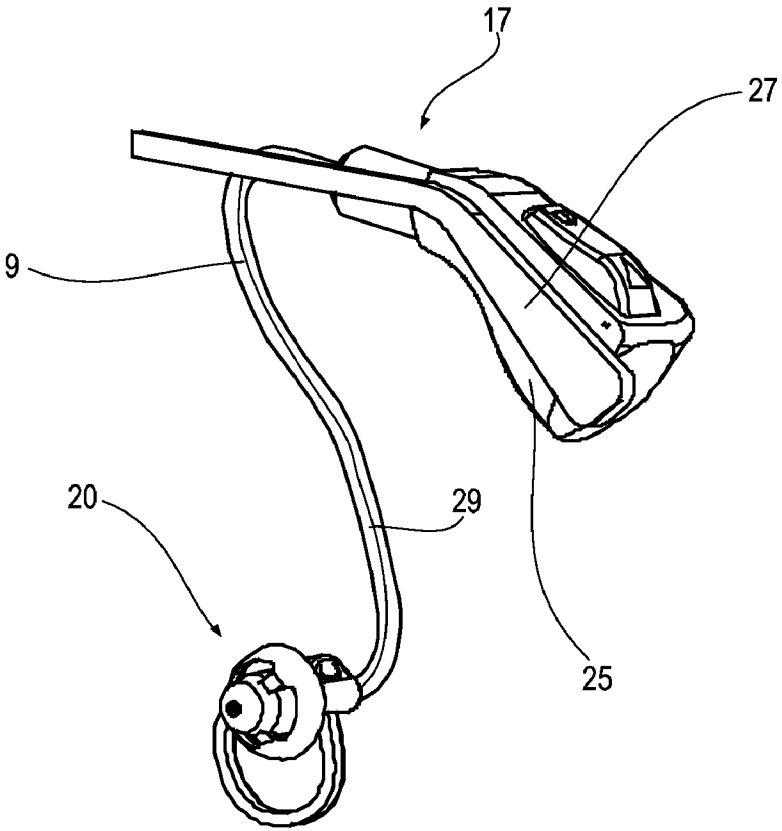
FIG. 13 shows a hearing aid system according to another embodiment, arranged adjacent a pair of spectacles.

In an alternative embodiment the receiver is placed in the ear plug 20 and connected to the other electrical components in the shell 25 by a wire 29 in the tube 9, thereby allowing a higher sound output (FIG. 13). Another design option for adapting the hearing aid for a high sound output is by creating a larger shell 25 and arranging the microphone and the receiver with a mutual spacing so as to decouple feedback inside the housing.

Figure 8:
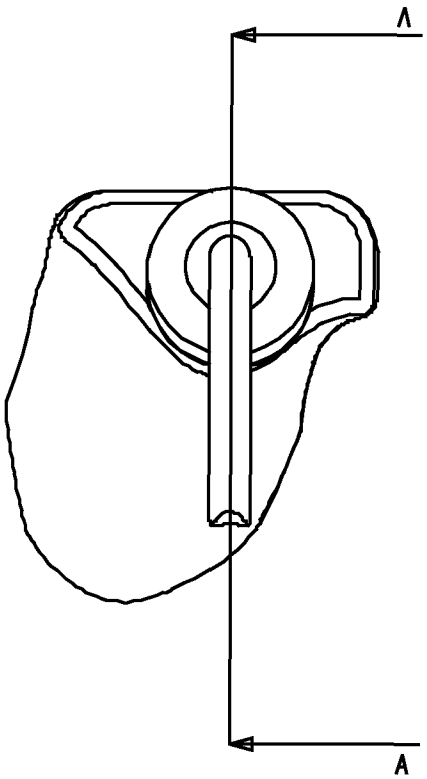
FIG. 8 shows a BTE hearing aid wherein the faceplate is integrated in the shell.
Figure 8:
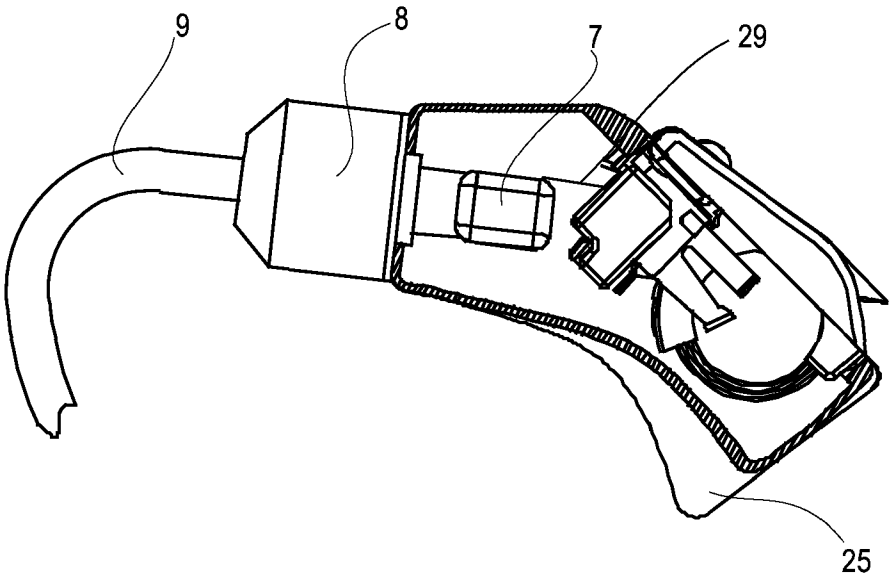

FIG. 8 shows a BTE hearing aid wherein the faceplate is integrated in the shell 25. All the electronic components are mounted through a hole in the shell 25 corresponding to the entrance opening in FIG. 8.

Figure 9:
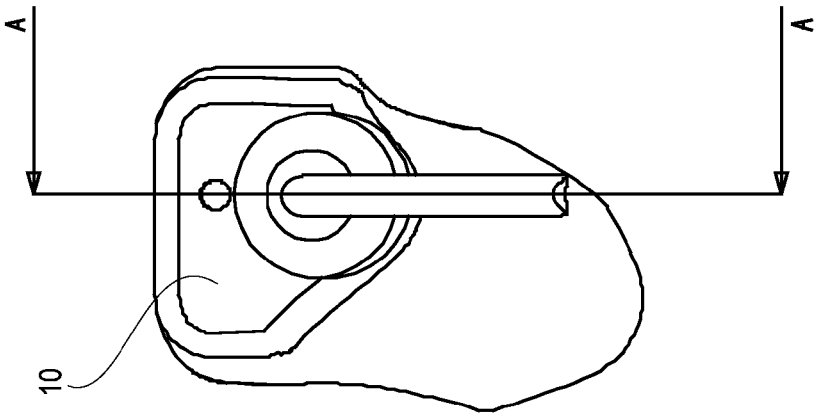
FIG. 9 shows an embodiment with a shell integrated with the faceplate and with a microphone entrance.
Figure 9:
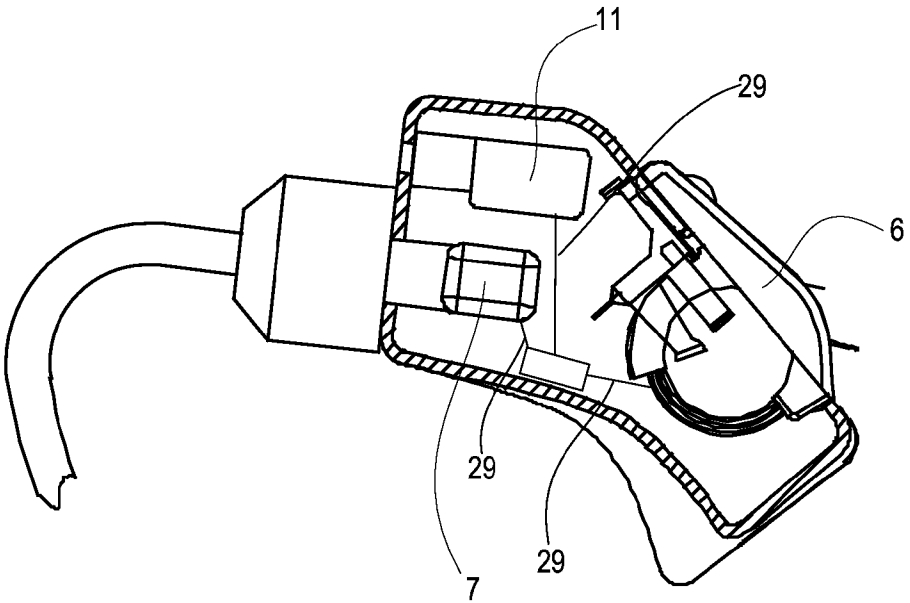

FIG. 9 shows another embodiment of the invention wherein the shell is integrated with the faceplate and has a microphone entrance 10 to which the microphone 11 is mounted to the shell 25. All the electronic components are mounted through an opening in the shell 25 corresponding to the entrance opening 4 in FIG. 6.

Figure 10:
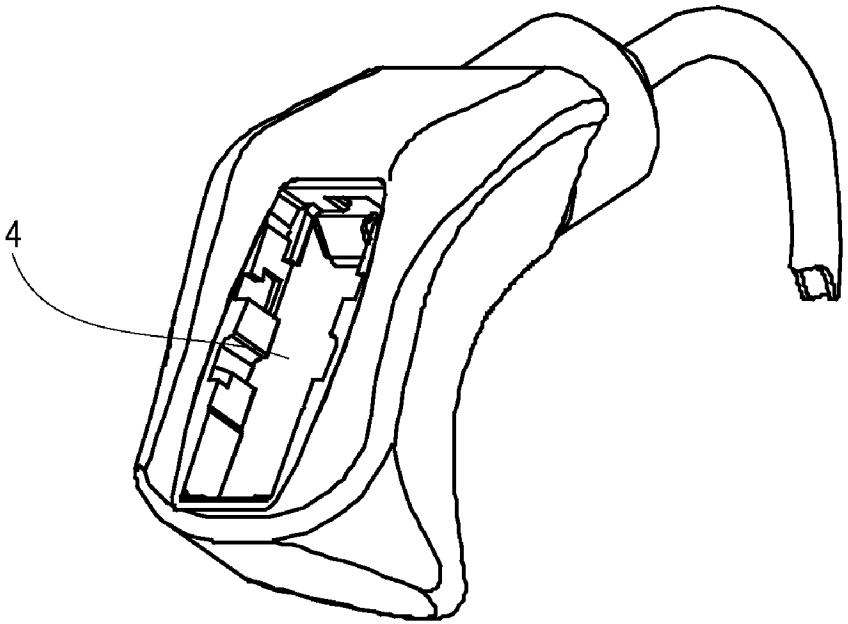
FIG. 10 shows a shell before the electronic components having been mounted.

FIG. 10 shows a shell 25 before the electronic components are mounted through the entrance opening 4. The entrance opening 4 corresponds to an opening for a battery compartment and for other details, e.g. as shown in WO 98/47319.

Figure 11:
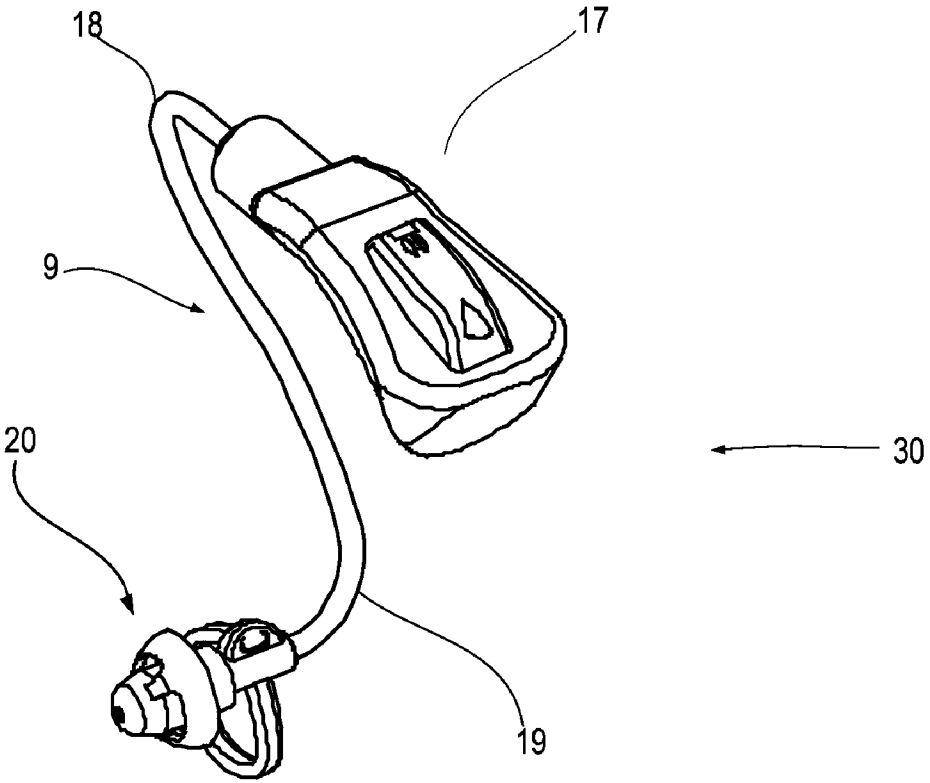
FIG. 11 shows a hearing system comprising a hearing aid, a tube, a connecting element, and an ear plug.

FIG. 11 shows a hearing system 30 comprising a hearing aid 17 a tube 9 and a connecting element 8 and an ear plug 20. A receiver may be arranged in the hearing aid 17 or it may be arranged in the earplug 20. If the receiver is arranged in the earplug 20, a higher output can be achieved without feedback, especially if a closed earplug 20 is used, in this case the receiver may be connected to the electronic components in the hearing aid 17 by a wire 29 in the tube 9.

The tube, or at least a part of it, is semi-rigid or resilient in order that the tube may also serve the purpose of resting the hearing aid on the external ear of the user. The earpiece is adapted, e.g. through resilience or customization to the users ear, to rest in the meatus of the ear canal.

The hearing aid comprises an ear plug for contacting the meatus of the users ear canal, a contact element for resting against an inside of the users tragus, and a fixture for holding the ear plug and the contact element together, the fixture having means for adjusting the spacing between the plug and the contact element. This type of plug provides a comfortable, partial support for the earpiece and is adapted to direct sounds amplified by the hearing aid towards the users ear canal. The support is complemented by the contact element, which rests against another part of the ear. The fixture permits adjusting the spacing between the plug and the contact element and thereby permits adapting the hearing aid to different sizes of ears, or to different preferences regarding pretension. The adjustment facility permits customizing the ear plug in order that it may accommodate a wide variety of users.

Figure 12:
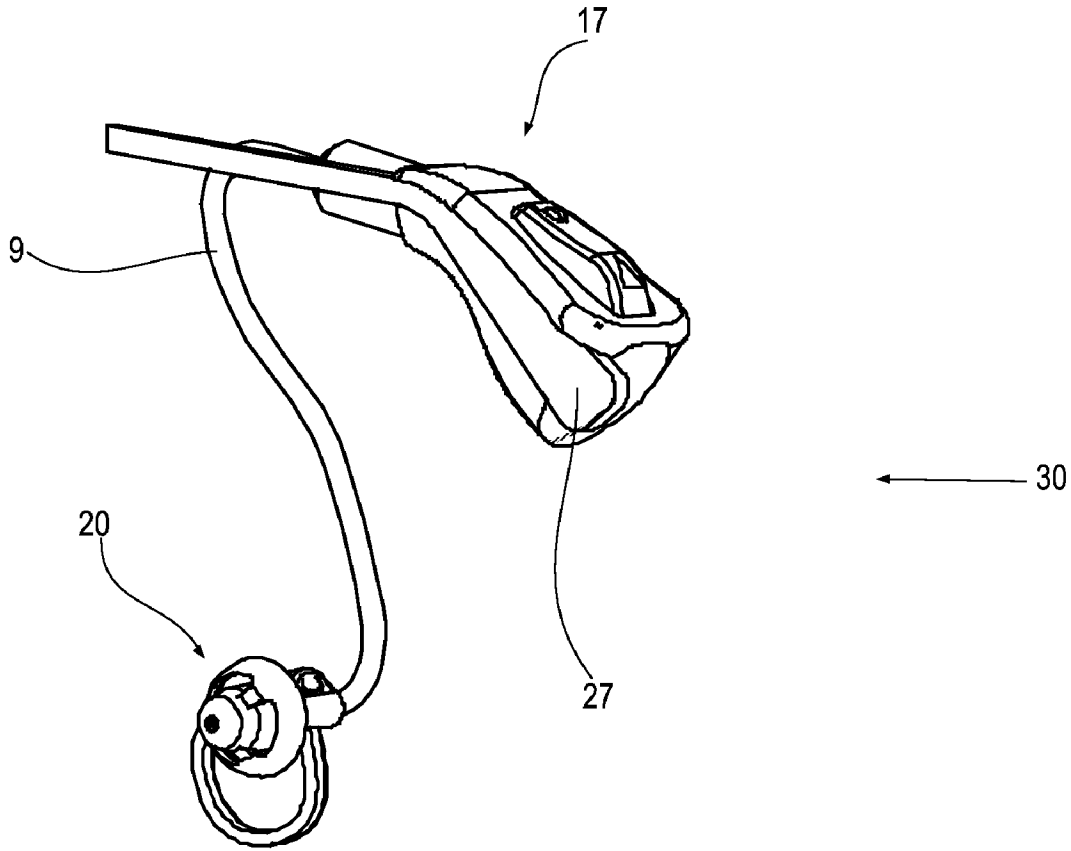
FIG. 12 shows a hearing aid system arranged adjacent a pair of spectacles.

FIG. 12 shows a hearing aid system 30 comprising a hearing aid 17, a tube 9 and an open earplug 20. The hearing aid 17 is adapted for a user wearing spectacles by an indentation 16 in the shell 25. Likewise, the hearing aid system 30 showed in FIG. 13 also comprises a shell 25 with an indentation 16 for an arm 27 of a pair of spectacles, the hearing aid system 30 further having a receiver in the earplug 20, which is connected to the hearing aid by a wire.

Figure 14:
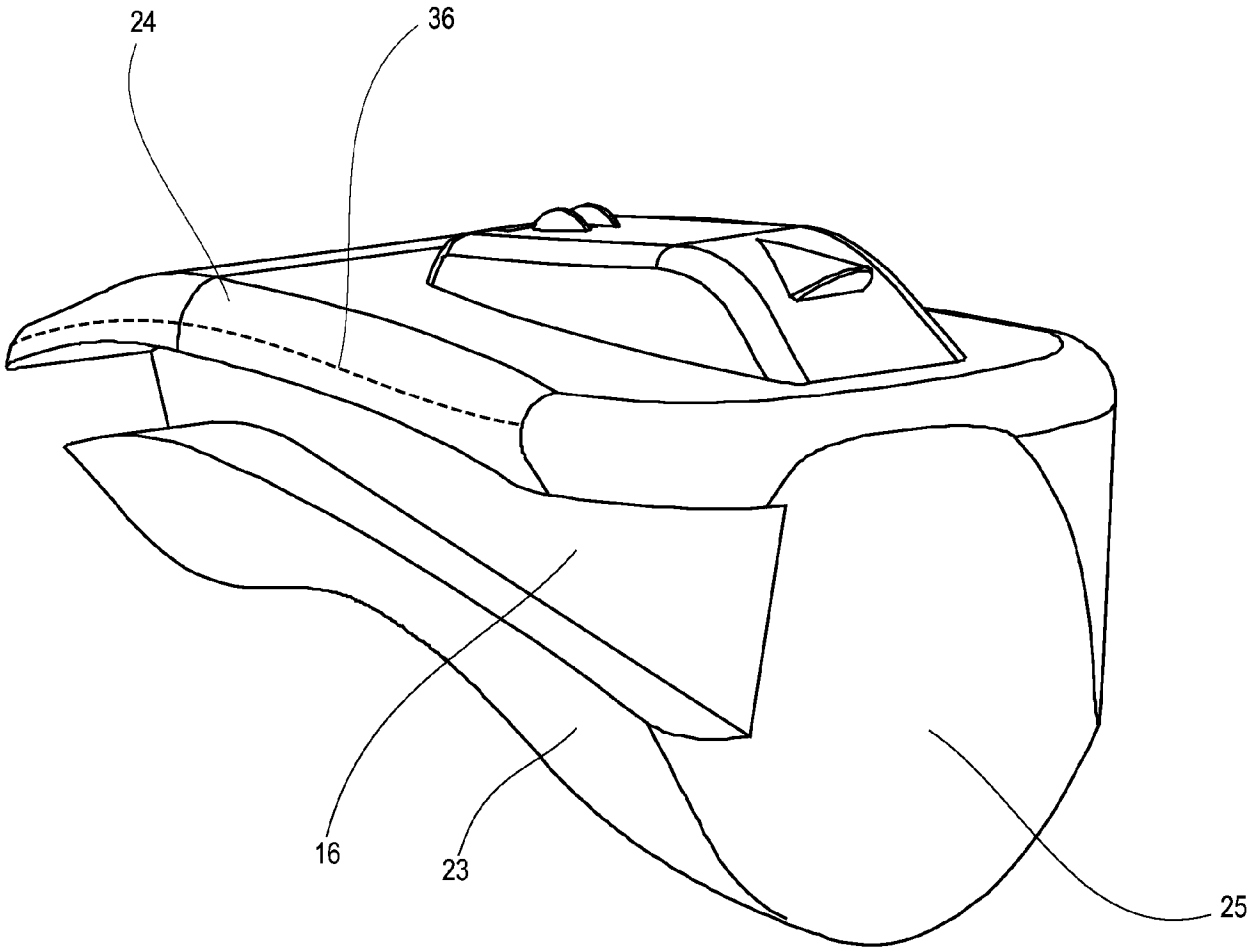
FIG. 14 shows a close-up of a shell with an indentation for spectacles.

FIG. 14 shows a close-up of a shell 25 with an indentation 16 for spectacles. In this embodiment, the shell comprises a first part 23 customized to the pinna and the skull of the user, a part, i.e. the indentation 16, customized to a shape of the spectacles, and a part, generally designated the second part 24, that completes the shell.

Figure 15:
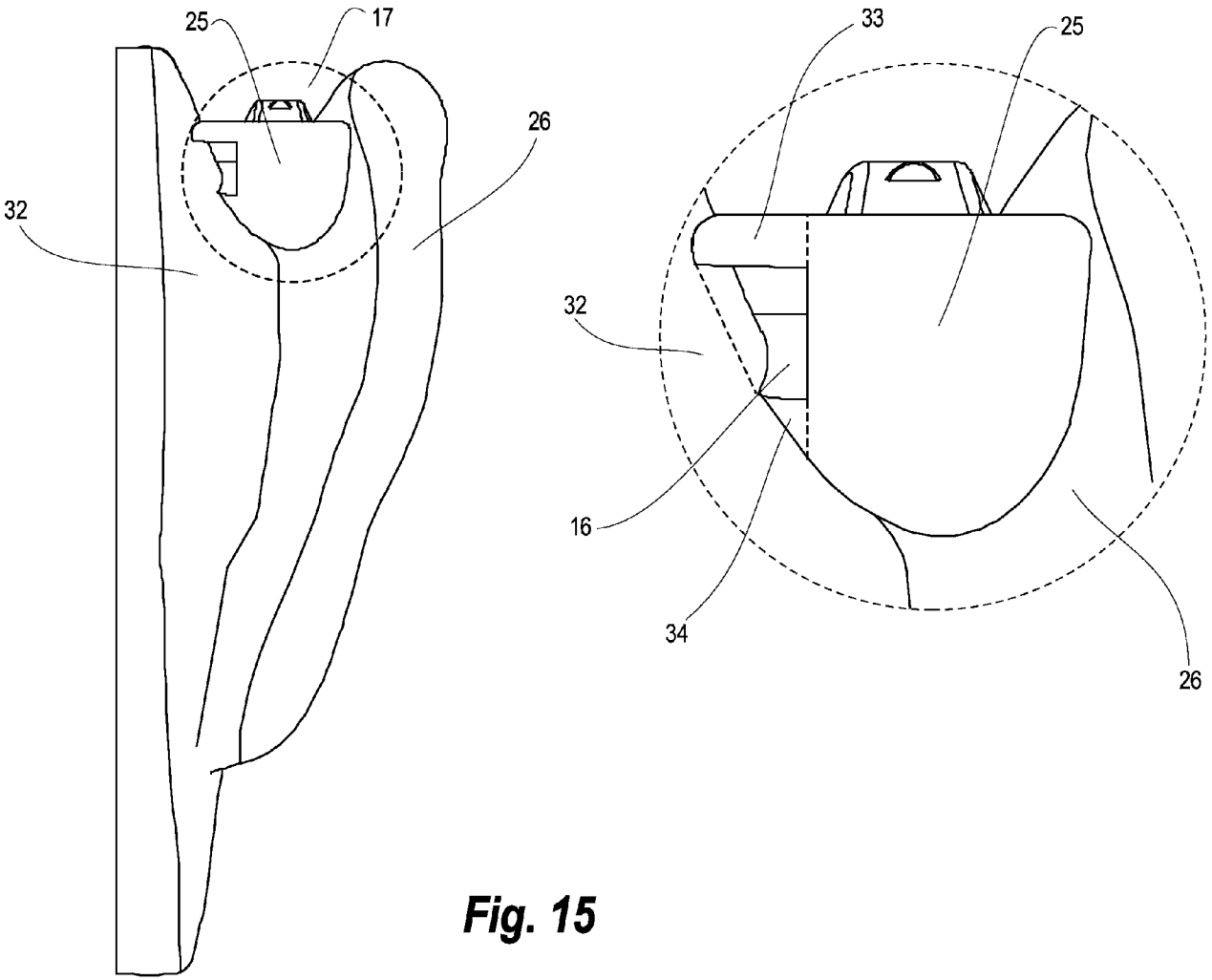
FIG. 15 represents a hearing aid according to FIG. 12 but placed in the cleft between the skull and pinna.

FIG. 15 represents a hearing aid 17 according to FIG. 12 when placed in the cleft between the skull 32 and pinna 26. In the detailed picture a dotted line connects the first lobe 33 and the second lobe 34, the line indicating the contour of the skull. An indentation 16 like the one for the hearing aid system shown in FIG. 13 appears if lobe 33 is removed. Other forms of an indentation 16 in the shell 25 appear by e.g. removing lobe 34 or both lobe 33 and lobe 34.

Figure 16:
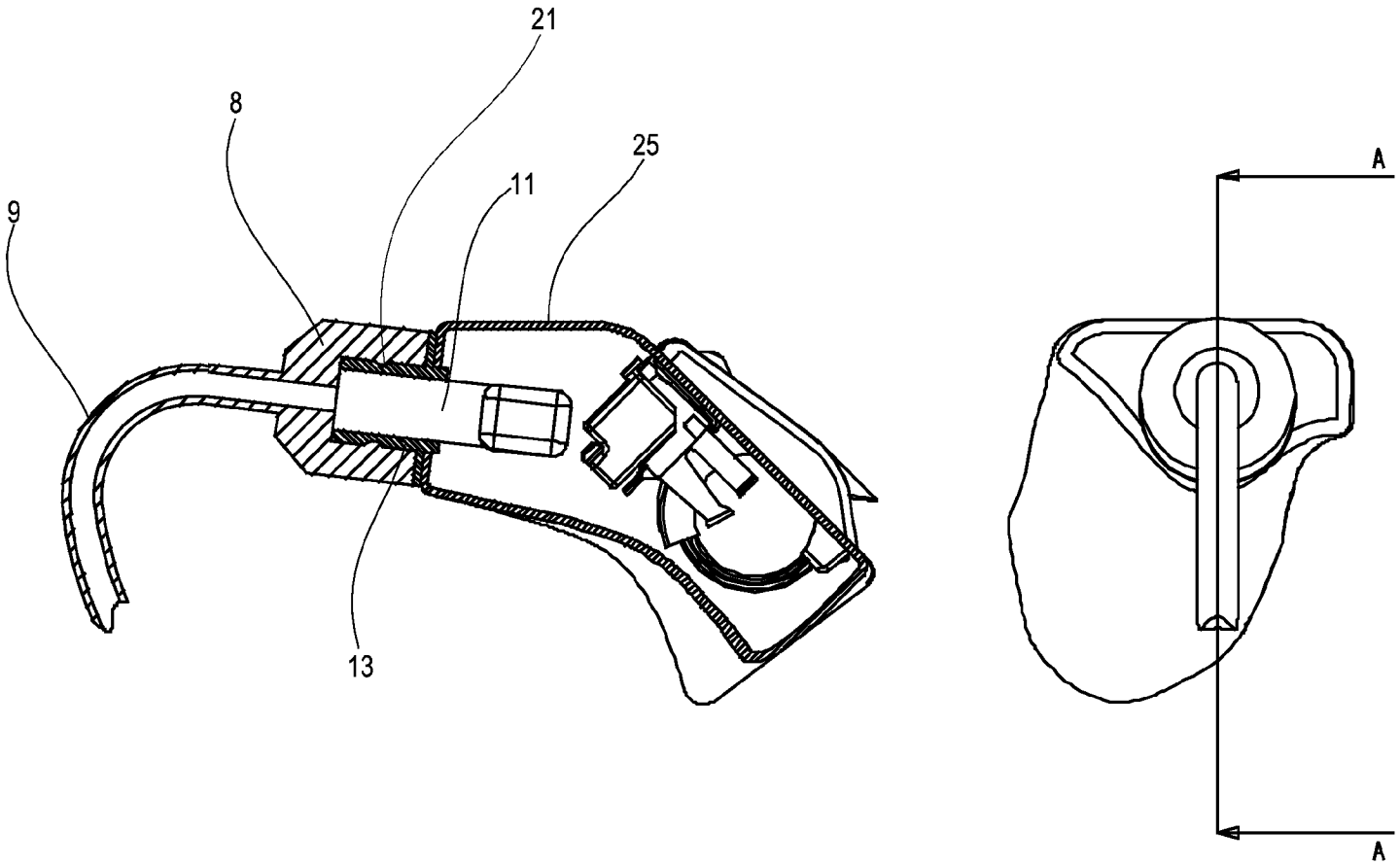
FIG. 16 shows a hearing aid housing in longitudinal section.

FIG. 16 shows a shell 25 joined with a connecting element 8 and a tube 9 via a bushing 13. The connecting element 8 has interaction means 21 for joining the shell to the bushing 13. Alternatively the connecting element 8 may be connected directly to the shell 25 e.g. by gluing the connecting element 8 to the shell 25. In another embodiment the bushing 13 is integrated in the shell 25.

I claim:

1. A method of preparing a Behind-The-Ear hearing aid for an individual hearing aid user, said method comprising the steps of providing an impression having a first part and a second part, the first part being directly cast by contact with the cleft between the skull and a pinna of said user, and the second part being adapted to complete the impression, said step of providing an impression comprising providing an impression of a part of an armature of a spectacle frame, molding a shell using the impression as a form, said step of molding a shell including providing an indentation adapted to fit said part of the armature of the spectacle frame, cutting said shell, whereby to provide a housing that has an aperture encircled by an edge, providing a faceplate, which faceplate has an entrance opening, adhering said faceplate to said edge, providing a module for supporting an amplifier assembly and a battery compartment, and inserting and securing said module through said entrance opening, whereby to complete the Behind-The-Ear hearing aid.

2. The method according to claim 1 comprising arranging at least one microphone in said housing.

3. The method according to claim 1, comprising arranging an acoustic output transducer in said housing.

4. The method according to claim 3, comprising connecting a sound tube to said housing.

5. The method according to claim 4, comprising a step of providing an outlet opening arranged at least partially in said second part.

6. The method according to claim 5, comprising connecting said sound tube to the acoustic output transducer out through said outlet opening.

7. A Behind-The-Ear hearing aid comprising a housing, a faceplate and a module, wherein said housing is manufactured by providing an impression having a first part and a second part, the first part being directly cast by contact with the cleft between the skull and a pinna of said user, and the second part being adapted to complete the impression, said impression including an impression of a part of an armature of a spectacle frame, molding a shell using the impression as a form, said shell including an indentation adapted to fit said part of the armature of the spectacle frame, and cutting said shell, whereby to provide a housing that has an aperture encircled by an edge, wherein said faceplate has an entrance opening and is adhered to said housing at said edge, and wherein said module includes an amplifier assembly and a battery compartment, and is adapted for mounting in the housing by inserting and securing said module through said entrance opening.

* * * * *